United States Patent [19]

Culbertson et al.

[11] 4,034,918

[45] July 12, 1977

[54] DRIVE ARRANGEMENT FOR ROTARY SHREDDING APPARATUS

[75] Inventors: Michael Culbertson, Sherwood, Oreg.; James E. Keller, Vancouver, Wash.

[73] Assignee: Saturn Manufacturing, Inc., Wilsonville, Oreg.

[21] Appl. No.: 602,287

[22] Filed: Aug. 6, 1975

[51] Int. Cl.[2] ..... B02C 23/00

[52] U.S. Cl. ..... 241/36; 241/286; 60/403; 60/444; 60/476; 60/DIG. 2

[58] Field of Search ..... 60/328, 329, 394, 403, 60/444, 452, 476, DIG. 2; 91/35, 38, 219, 491; 241/DIG. 15, 227, 141, 220, 231, 36, 236; 417/12

[56] References Cited

U.S. PATENT DOCUMENTS

| | | | |
|---|---|---|---|
| 459,736 | 9/1891 | Benham | 91/491 X |
| 2,674,231 | 4/1954 | Erickson | 91/219 |
| 2,984,985 | 5/1961 | MacMillin | 60/471 X |
| 3,366,016 | 1/1968 | Anderson | 91/438 |
| 3,860,180 | 1/1975 | Goldhammer | 241/236 X |
| 3,868,062 | 2/1975 | Cunningham et al. | 241/36 |

*Primary Examiner*—Edgar W. Geoghegan

*Attorney, Agent, or Firm*—Klarquist, Sparkman, Campbell, Leigh, Hall & Whinston

[57] ABSTRACT

A rotary shredder for waste materials has a pair of counterrotating cutting shafts, each of which mounts a series of spaced-apart disc-type cutters. The cutters on one shaft extend into the spaces between cutters on the other shaft so that the cutters on the two shafts coact to shred material fed therebetween. The two shafts are driven by a reversible radial piston hydraulic motor through a gear train arranged to rotate one cutter shaft at twice the speed of the other. The hydraulic motor is driven by an electric motor-driven fixed or variable displacement pump. A flow-reversing valve in the hydraulic motor control circuit controls the direction of fluid flow through the hydraulic motor. The reversing valve is electrically actuated automatically by a fluid pressure-operated switch to reverse flow and the direction of rotation of the cutters to prevent jamming whenever fluid pressure in the motor circuit rises to an abnormally high level. Upon detecting high pressure, the switch energizes a time delay relay which closes a relay contact to energize a solenoid which actuates the flow-reversing valve for a predetermined time period, after which the valve shifts to its normal position to operate the hydraulic motor in its normal directional mode to resume shredding.

11 Claims, 6 Drawing Figures

DRIVE ARRANGEMENT FOR ROTARY SHREDDING APPARATUS

BACKGROUND OF THE INVENTION

1. Field of the Invention

The present invention relates to a drive arrangement for a rotary-type shredder, and more particularly to a hydraulic drive with a hydraulic pressure-actuated electrical reversing control.

2. Description of the Prior Art

Most rotary shredding devices of the type disclosed are driven directly by an electric motor through an appropriate speed-reducing transmission as shown, for example, in U.S. Pat. No. 3,845,907.

Although such electric drive motors may be provided with overload protection or a reversing circuit, as shown in such prior patent, they nevertheless tend to burn out when subjected to sudden excessive torque demands, such as when the cutters are jammed with material too hard or large for them to handle. Because of this deficiency in direct electric drives for such rotary shredders, they have also been driven with hydraulic motors using electric motor-driven hydraulic pumps to supply pressure fluid to such hydraulic motors. In this way the hydraulic motor circuit can be designed with relief valves to prevent excessive operating pressures and in this way isolate the electric pump motor from excessive torque loads. Such hydraulic motor circuits have also been designed with hydraulic reversing controls to automatically reverse the hydraulic motor when the shredder approaches a jamming condition to prevent such a condition. However, such hydraulic reversing controls have been unsatisfactory in that they are inconsistent and unreliable in their operation because of the effects of the varying temperature, viscosity and flow rate of the hydraulic fluid in the motor circuit.

Accordingly there is a need for a hydraulic drive for rotary shredders to prevent the burning out of electric motors and furthermore a hydraulic drive arrangement with a reliable and automatic reversing control to reverse the cutters and thereby prevent their jamming without the need for deactivating the shredder or its drive.

SUMMARY OF THE INVENTION

According to the present invention, the foregoing problem is solved by providing a hydraulic drive arrangement for rotary shredders which includes a hydraulic control circuit with fluid pressure-actuated, electrically operated means for reversing the operation of the hydraulic motor and thus the cutters to prevent their jamming. The electrically operated reversing control is responsive to excessive hydraulic motor circuit pressures indicative of an approaching jamming condition but independent of the temperature, viscosity and flow rate of the hydraulic pressure fluid in the motor circuit so as to provide consistent, automatic initiation and reliable operation of the reversing function.

The reversing control comprises a flow-reversing valve in the hydraulic motor or pump control circuit which is normally biased in a position to drive the hydraulic motor in a direction for shredding material. However, when the fluid pressure in the motor circuit rises to a level indicative of an approaching jamming condition in the shredder, a fluid pressure-operated electrical switch sensitive to motor circuit pressure closes to energize an electrically operated time delay, which in turn energizes a solenoid which shifts the flow-reversing valve to reverse the direction of motor operation. After a predetermined time period, the time delay times out, de-energizing the valve solenoid and thereby returning the motor to its original directional mode. In this way variables such as temperature, viscosity and flow rates of the hydraulic fluid do not influence the operation of the reversing feature.

A primary object of the invention, therefore, is to provide a rotary shredder with a hydraulic drive having a reliable and foolproof reversing control which consistently prevents jamming of the shredder without requiring its shutdown.

Another primary object is to provide a rotary shredder with a hydraulic drive arrangement having an electro-hydraulic reversing control which operates automatically in response to hydraulic motor system pressures and independently of the temperature, viscosity and flow conditions of the hydraulic pressure fluid.

Another important object is to provide a reversing control as aforesaid which is simple, reliable and automatic in operation to prevent jamming of the shredder.

Still another important object is to provide a hydraulic drive arrangement which protects the primary and secondary drive motors from damage in the event of jamming or near-jamming conditions in the shredder.

The foregoing and other objects, features and advantages of the present invention will become more apparent from the following detailed description, which proceeds with reference to the accompanying drawings.

DETAILED DESCRIPTION

Figure 1:
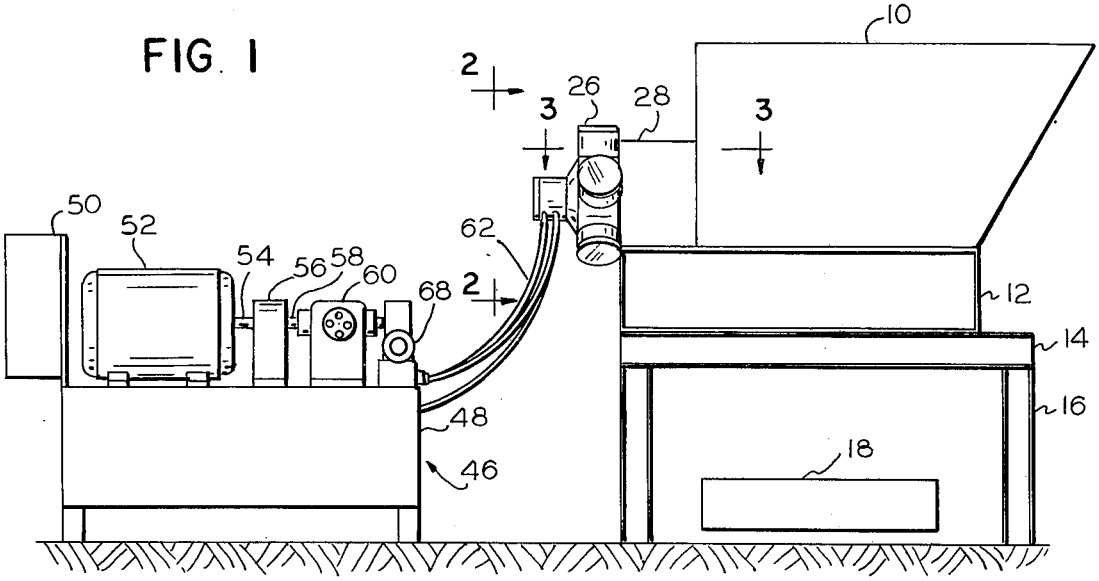
FIG. 1 is a side elevational view of a rotary shredder utilizing a drive system in accordance with the present invention.
Figure 2:
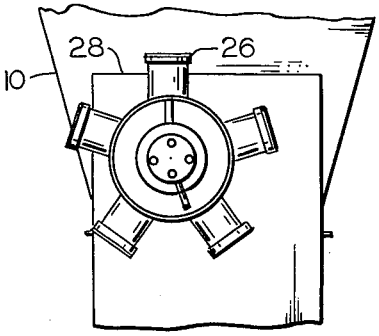
FIG. 2 is an end view of a portion of the apparatus as viewed in the direction 2—2 of FIG. 1.
Figure 3:
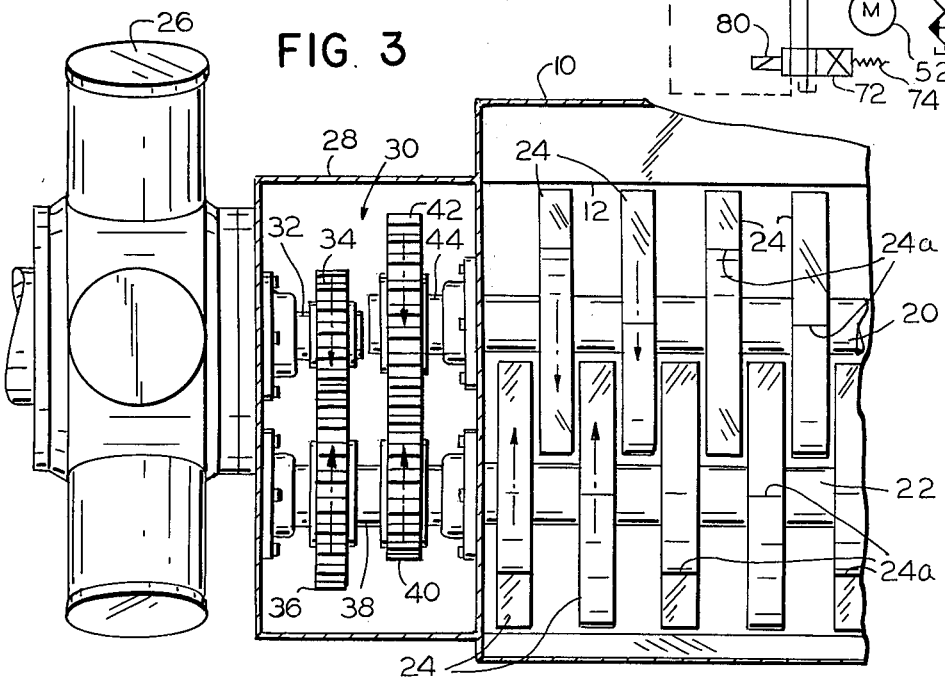
FIG. 3 is a horizontal sectional view taken approximately along the line 3—3 of FIG. 1.

With reference first to FIGS. 1–3 of the drawings, the drive system of the present invention is adapted for use with a rotary shredding apparatus including an upwardly opening hopper 10 for feeding rubber tires, glass, scrap wood, masonry and other difficult-to-shred waste materials, into the shredding elements of the apparatus. Such elements are housed within a shredder housing 12 below the hopper and mounted on a support frame 14 supported on legs 16 over a belt conveyor 18 for receiving shredded material deposited through a bottom opening of the shredder housing.

The shredding elements of the apparatus are shown in FIG. 3 and comprise essentially a pair of parallel, horizontally spaced-apart, driven cutter shafts 20, 22, each mounting a series of identical disc-type cutter elements 24 at equally spaced-apart positions along the shafts. The cutters 24 on shaft 20 are fixed at positions along such shaft so that they extend into the spaces between the cutters 24 of the other shaft 22. The shafts are driven in opposite directions so that the upper portions of the cutters on the two shafts rotate toward each other, forcing materials fed into the hopper from above downwardly between the two shafts to shred them.

The cutter discs themselves may have a profile configuration similar to any one of several well-known types, such as shown in U.S. Pat. Nos. 3,146,960, 3,630,460, 3,664,592 and 3,845,907. Typically such cutter discs include peripheral shredding teeth such as indicated at 24*a* on the discs 24 which interact with corresponding teeth on the adjacent discs of the other shaft. The arrows on some of the discs of the two shafts indicate the direction of rotation of the respective shafts as viewed from above in FIG. 3.

Cutter shafts 20 and 22 are driven by a radial piston hydraulic motor 26 mounted to one end of a transmission housing 28 housing a gear train 30 for transmitting power from the output shaft 32 of the motor 26 and counterrotating the cutter shafts. The gear train also provides a desired speed reduction from the output shaft to the cutter shafts and is designed to rotate the cutter shafts at different speeds, preferably at a 2:1 speed ratio. For this purpose a gear 34 on the output shaft 32 of the hydraulic motor 26 meshes with a gear 36 having twice the number of teeth as gear 34 on an extension 38 of cutter shaft 22 to drive shaft 22 at one-half the speed of output shaft 32. A second gear 40 on cutter shaft extension 38 meshes with a large gear 42 on an extension 44 of cutter shaft 20. Gear 42 has twice the number of teeth as gear 40 so as to rotate shaft 20 at one-half the speed of shaft 22 and in a direction opposite the direction of rotation of shaft 22.

A separate support table 46 supports the hydraulic and electrical components of the system for driving hydraulic motor 26. Such table includes a hydraulic tank 48, one end of which supports an electrical control panel 50. An electric motor 52 mounted on top of tank 48 drives through an output shaft 54, shaft coupling 56 and input shaft 58, a hydraulic fluid pumping means 60. Hydraulic pressure fluid is delivered from pumping means 60 to the hydraulic motor 26 and from the hydraulic motor back to the pumping means or tank through hydraulic supply and return hoses 62 forming part of the hydraulic circuit for the fluid motor.

Figure 4:
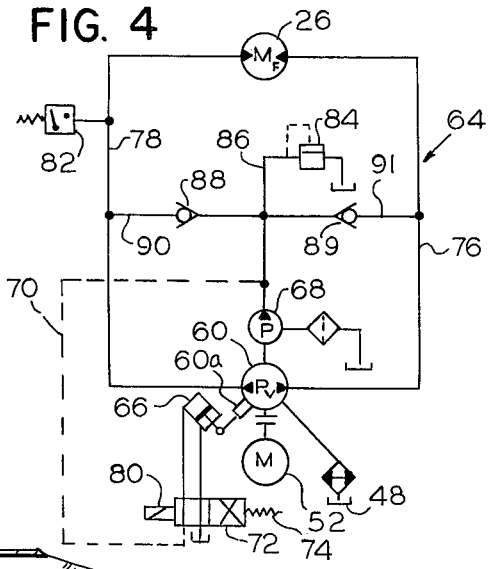
FIG. 4 is a hydraulic circuit diagram showing a hydraulic drive system for the shredder of FIG. 1.

It will be clear from FIG. 4 showing the hydraulic motor circuit 64 containing the hydraulic fluid pumping means 60 and hydraulic motor 26, that pumping means 60 is a variable displacement pump having a variable displacement servo means 60*a*. Pump 60 is also reversible through control of the position of a hydraulically operated reversing means in the form of a servo piston and cylinder 66.

Electric motor 52 also drives a fixed displacement servo pump 68 which supplies pressure fluid through a pilot control passage 70 in a subcircuit of the fluid motor circuit to one or the other of the opposite ends of pump-reversing cylinder 66, depending on the position of a two-position flow-reversing valve 72 in such subcircuit. Valve 72 is normally biased by a spring 74 to a first position (not shown) to deliver pressure fluid from servo pump 68 through pilot passage 70 to the rod end of reversing cylinder 66 to cause pump 60 to deliver pressure fluid through a passage 78 of circuit 64 to hydraulic motor 26 and from motor 26 back to pump 60 through a second passage 76 of the circuit. Flow-reversing valve 72 is shifted by an electrical solenoid 80 against the pressure of spring 74 to its flow-reversing position shown in FIG. 4 to reverse the pump 60 and thereby reverse the direction of flow from the pump so that the flow of pressure fluid proceeds through passage 76 of the circuit to motor 26 and from motor 26 through passage 78 back to pump 60, thereby reversing also the direction of rotation of the output shaft of the motor 26, and the directions of rotation of the two cutter shafts 20 and 22. Thus servo pump 68, flow-reversing valve 72 and servo cylinder 66 define fluid flow-reversing means for reversing the operation of fluid motor 26. From FIG. 3 it will be apparent that when cutter shafts 20 and 22 rotate in a direction opposite that shown through reversal of motor 26, the cutters will no longer feed material into the cutters and between such shafts. Instead, the cutters will tend to disgorge any material from between the shafts and the cutters to prevent jamming of the shredder and any resultant damage to the drive system, shafts or cutters.

Hydraulic circuit 64 also contains a fluid pressure-operated electrical switching means 82 which is normally open when pressures within the primary hydraulic circuit defined by passages 76 and 78 are within a normal pressure range. Switch 82 is sensitive to fluid pressure within circuit 64 above such range to close and thereby complete an electrical control circuit which in turn energizes the electrical solenoid 80 of flow-reversing valve 72 for a predetermined time period. The electrical control circuit is shown in FIG. 6 and will be described below.

The subcircuit of hydraulic circuit 64 also includes a high pressure relief valve 84 connected to servo pump 68 through a passage 86 to dump pressure fluid to tank 48 whenever the hydraulic pressure in the subcircuit of pump 68 exceeds a predetermined upper limit. Check valves 88, 89 in passages 90, 91 interconnecting the subcircuit portion and the primary fluid circuit of pump 60 prevent the flow of pressure fluid from the primary circuit to the subcircuit but permit the flow of makeup fluid from the pilot circuit to the primary circuit when the pressure in the subcircuit exceeds the pressure in the primary circuit.

Figure 6:
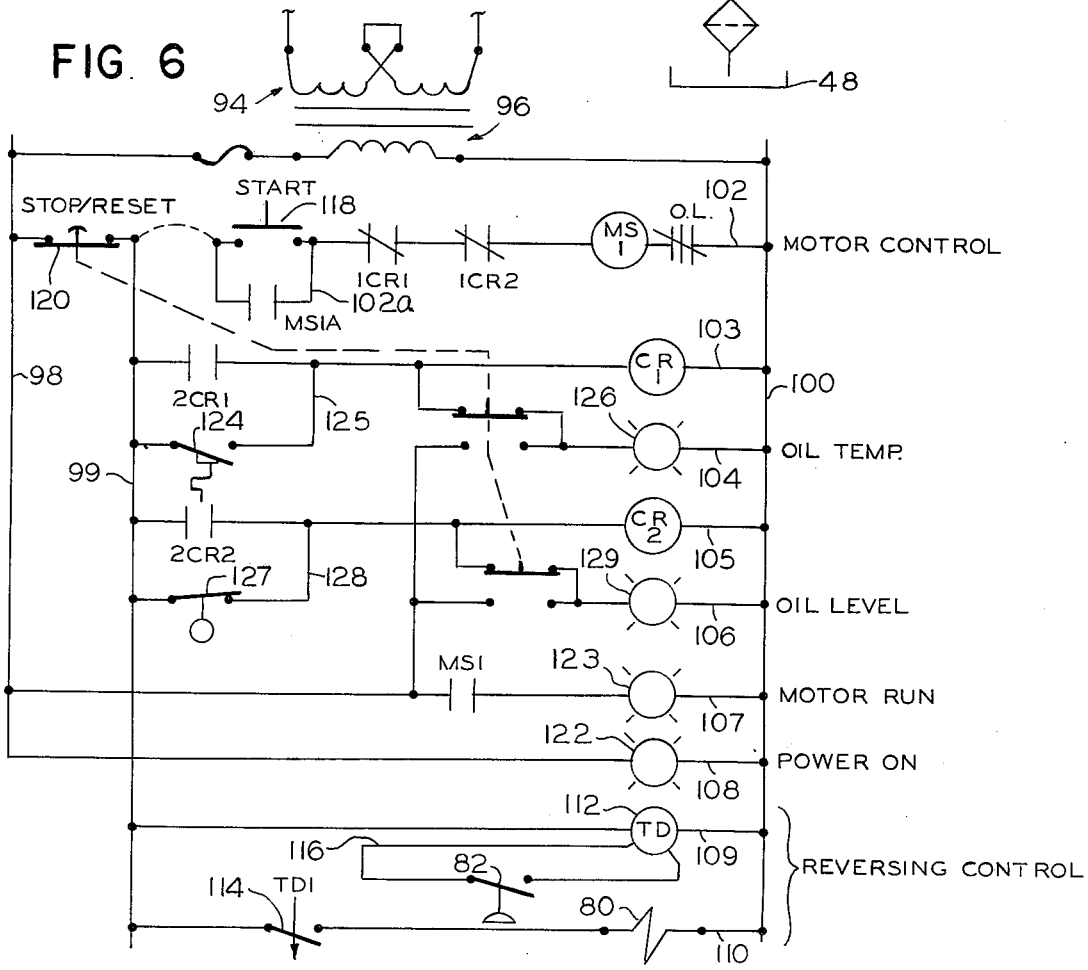
FIG. 6 is an electrical circuit diagram showing the electrical control portion of the drive system in accordance with the invention.

The electrical circuit of FIG. 6 shows only a portion of circuit 94 for electric drive motor 52 and a transformer 96 which steps up voltage from the electrical control portion of the circuit to motor circuit 94. The electrical control portion of the circuit includes the primary electrical conductors 98, 99 and 100. The control circuit in general includes a number of subcircuits including a motor start-stop circuit 102, a relay circuit 103 containing a relay CR-1, an oil temperature subcircuit 104, a second relay subcircuit 105 containing a relay CR-2, an oil level monitoring subcircuit 106, a motor run subcircuit 107, a power on subcircuit 108, and a reversing control subcircuit including the conductors 109, 110 and 116.

The majority of the control circuit disclosed is substantially conventional and is illustrated for the purpose of showing a typical control circuit for the electric motor 52 and for monitoring the oil level and oil temperature in the hydraulic circuit for fluid motor 26. The operation of such portions of the control circuit will be readily apparent to those skilled in the art from the diagram of FIG. 6 and from the description of the operation of the fluid motor drive and reversing control which follows.

The reversing control subcircuit is important to the invention and to the operation of the hydraulic control circuit of FIG. 4. Such subcircuit includes a time delay relay 112 in line 109 which controls the operation of the normally open relay contact 114 in line 110. Line 110 also includes the valve solenoid 80 for operating the flow-reversing valve 72 of FIG. 4. The pressure-operated switch 82 operated by high pressure in hydraulic circuit 64 is contained in the subcircuit 116 which also includes the time delay relay 112. Both the subcircuits 109 and 116 must be completed to activate relay 112.

OPERATION

In operation electric motor 52 is started by depressing start switch 118 of motor control subcircuit 102. This energizes motor relay MS-1, closing relay contacts to start electric motor 52. The energizing of relay MS-1 also closes relay contact MS-1A in a subcircuit 102A to keep motor control circuit 102 closed until a stop/reset switch 120 in motor control circuit 102 is depressed. Also when stop/reset switch 120 is depressed, it opens all of the remaining subcircuits branching from primary conductor 99. Whenever there is power to the general control circuit through primary conductors 98 and 100, a white indicator light 122 on the control panel and in subcircuit 108 is illuminated. Whenever motor control relay MS-1 in subcircuit 102 is energized, a relay contact MS-1 in subcircuit 107 closes to illuminate a blue indicator light 123 on the control panel to indicate that electric motor 52 is running.

Whenever the oil temperature in hydraulic motor circuit 64 rises above a predetermined safe level, a temperature-sensitive switch 124 in a conductor 125 closes, energizing relay CR-1 in subcircuit 103 to open a relay contact 1CR1 in motor control subcircuit 102, shutting off the motor 52, and also energizing a red warning light 126 on the control panel and in the oil temperature subcircuit 104.

Whenever the oil level in the tank 48 drops below a safe level, a float switch 127 in a subcircuit 128 closes to energize CR-2 in subcircuit 105, opening a relay contact 1CR2 in motor control subcircuit 102 to shut off motor 52 and also energizing a red warning light 129 on the control panel and in subcircuit 106.

With electric motor 52 running, pump 60 is driven in a direction to deliver pressure fluid through line 78 to the hydraulic motor 26, thereby driving the cutter shafts 20 and 22 in their desired directions for shredding material. Reversing control valve 72 is in its spring-biasing position (not shown) to deliver pilot flow from pilot line 70 to the piston rod end of servo cylinder 66. Solenoid 80 is de-energized because time delay contact 114 in subcircuit 110 of the electrical control circuit is open. This contact is open because pressure switch 82 in subcircuit 116 is also open, thereby maintaining time delay relay 112 in a de-energized condition.

When material being fed into the shredder between the cutter shafts 20 and 22 slows rotation of such shafts to the point where jamming is likely to occur, the fluid pressure in hydraulic circuit 64 rises above its safe upper limit level, causing pressure-operated switch 82 in subcircuit 116 to close, thereby energizing time delay relay 112. Time delay relay contact 114 in subcircuit 110 thus closes, energizing solenoid 80. Solenoid 80 shifts flow-reversing valve 72 to the position shown in FIG. 4, reversing pilot flow to reversing cylinder 66 of primary pump 60, reversing such pump and the flow to fluid motor 26, thereby reversing such motor. Reversal of motor 26 reverses the counterrotation of cutter shafts 20 and 22, disgorging material upwardly from between such shafts to eliminate the danger of jamming.

After a predetermined time period determined by the time delay setting of relay 112, relay contact 114 reopens, de-energizing valve solenoid 80 and causing such valve to return to tis spring-biased normal position. Pump 60 is thus returned to its normal directional mode of operation and flow through hydraulic circuit 64 returns to normal to drive motor 26 in the desired direction to drive cutter shafts 20 and 22 in their shredding directions.

It is usually sufficient to set the time delay relay to reopen relay contact 114 in from one to three seconds after closing. If pressure switch 82 is still closed upon the reopening of relay contact 114, such contact will immediately be reclosed and will time out before reopening. This will continue until the pressure in the hydraulic circuit is reduced to a sufficient level to enable pressure-operated switch 82 to reopen indicating that the hydraulic circuit is operating within its normal pressure ranges and the shredder is cleared.

FIG. 5 MODIFICATION

Figure 5:
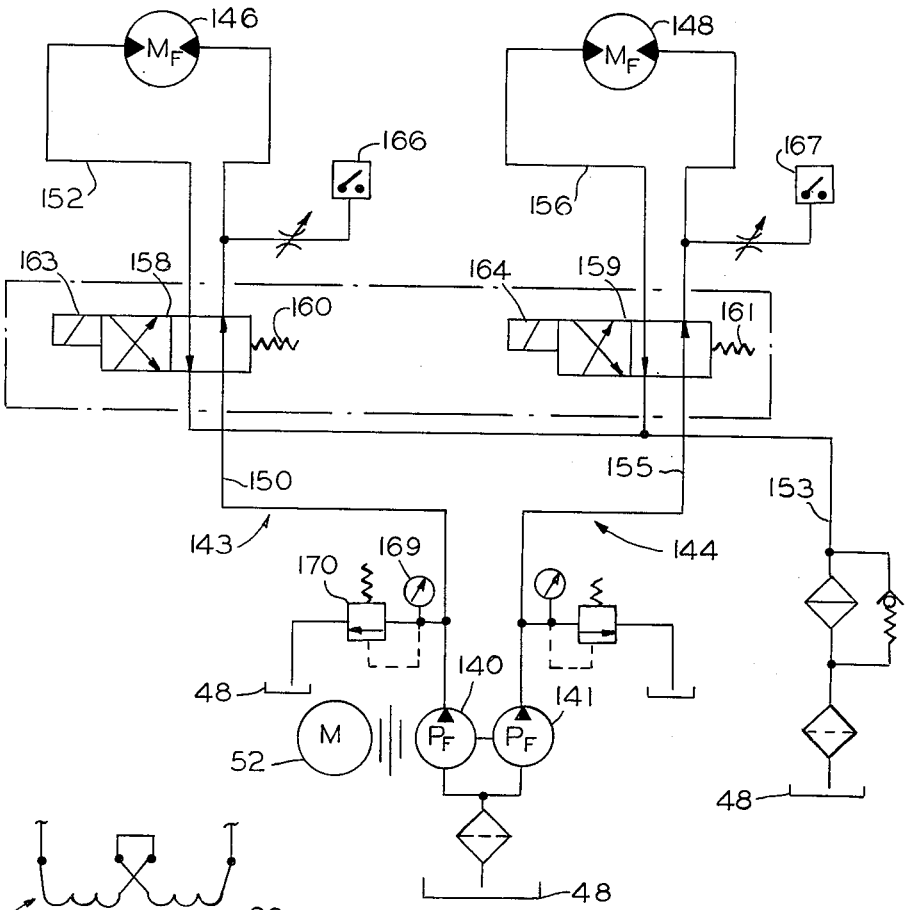
FIG. 5 is a hydraulic circuit diagram showing a modified form of hydraulic drive system in accordance with the invention.

FIG. 5 shows an open loop modification of the closed loop hydraulic circuit of FIG. 4, using a fixed displacement pumping means. The illustrated circuit is for driving a modification of the shredding apparatus in which each of the shafts 20 and 22 is driven by a separate hydraulic motor or alternatively in which two pairs of cutter shafts are used, with a separate hydraulic motor driving each pair of shafts.

In the hydraulic circuit of FIG. 5 the electric motor 52 drives a pair of mechanically coupled fixed displacement nonreversing hydraulic pumps 140, 141, each of which draws hydraulic pressure fluid from the common tank 48 but delivers the pressure fluid respectively to separate hydraulic motor circuits 143, 144 for the separate reversible hydraulic gear motors 146, 148. Circuit 143 includes the fluid supply line 150 leading to what is normally the intake side of the hydraulic motor 146 and a fluid return line 152 from such motor to a common return line 153 leading to tank 48.

Similarly, motor circuit 144 includes a fluid supply line 155 supplying pressure fluid from pump 141 to the intake side of hydraulic motor 148. A return line 156 from the motor is connected to the common return line 153 leading to tank 48.

Each of the separate motor circuits 143, 144 includes a separate motor-reversing means, each comprising a two-position flow-reversing valve 158, 159. Each valve is spring biased to its normal directional flow position by a spring 160, 161 respectively. Each valve is also operated by a separate solenoid 163, 164 respectively. If motors 146, 148 are used to drive the same pair of shafts, solenoids 163 and 164 could be in the same electrical reversing circuit as shown in FIG. 6. However, if such motors are used to drive separate pairs of cutter shafts operated independently of the other, solenoids 163, 164 preferably would be provided in separate electrical reversing circuits, each as shown in FIG. 6.

Separate pressure-operated electrical switches 166, 167 for each of the hydraulic motor circuits 143, 144 sense fluid pressure on the upstream side of their respective motors 146, 148. Each switch closes when such pressure rises to a predetermined upper limit indicative of the desirability of flow reversal to prevent jamming. When one of such switches senses high pressure in its hydraulic circuit, the switch closes to energize a time delay relay. Thereupon a relay contact closes to energize the valve solenoid for the associated flow-reversing valve to reverse the associated hydraulic motor and thereby reverse rotation of the connected cutter shafts, all as previously described with respect to the electrical reversing control subcircuit of FIG. 6.

Each of the hydraulic motor circuits 143, 144 also includes a pressure gauge 169 and a high pressure relief valve 170 to divert flow from the respective circuits to the tank 48 if the hydraulic circuit pressure should exceed a predetermined upper limit pressure higher than that required to operate the pressure switch in such circuit.

From the foregoing description of the operation of the electro-hydraulic control system for the hydraulic shredder drives, it should be apparent that a control system is provided which provides automatic reversing responsive to system pressure for a predetermined length of time independent of the viscosity, temperature and flow conditions of the hydraulic pressure fluid to provide failsafe, nonjamming operation of the shredder.

Having illustrated and described what is presently a preferred embodiment of our invention and one modification thereof, it should be apparent to those skilled in the art that the preferred embodiment may be modified in arrangement and detail without departing from the principles of the invention which are intended to be illustrated but not limited by the disclosure. We therefore claim as our invention all such modifications as come within the true spirit and scope of the following claims.

We claim:

1. A drive arrangement for a shredding apparatus in which a pair of parallel spaced-apart driven cutter shafts mount coacting counterrotating disc-type cutter elements, said drive arrangement comprising:

hydraulic fluid-pumping means, reversible hydraulic motor means, hydraulic fluid circuit means containing said hydraulic pumping means and said hydraulic motor means, flow-reversing means for reversing the flow of hydraulic fluid in said hydraulic circuit from said pumping means to said hydraulic motor means, electrically operable means for actuating said flow-reversing means including a fluid pressure-operated electrical switch means in an electrical control circuit sensitive to hydraulic pressure in said hydraulic circuit, said flow-reversing means including a flow-reversing valve in said hydraulic circuit means and said electrically operated means for actuating said flow-reversing means including a solenoid for shifting said valve from a normal position to a flow-reversing position, said solenoid being energizable by time delay means energized by said fluid pressure-operated electrical switch means, said time delay means including a time delay relay in said electrical control circuit, said time delay relay being energizable by said fluid pressure-operated electrical switch means to close a relay contact for a predetermined length of time and thereby energize said solenoid to reverse the flow of fluid and thereby reverse said hydraulic motor means for the same said length of time.

2. A drive arrangement for a shredding apparatus in which a pair of parallel spaced-apart driven cutter shafts mount coacting counterrotating disc-type cutter elements, said drive arrangement comprising:

hydraulic fluid-pumping means, reversible hydraulic motor means, hydraulic fluid circuit means containing said hydraulic pumping means and said hydraulic motor means, flow-reversing means for reversing the flow of hydraulic fluid in said hydraulic circuit from said pumping means to said hydraulic motor means, electrically operable means for actuating said flow-reversing means including a fluid pressure-operated electrical switch means in an electrical control circuit sensitive to hydraulic pressure in said hydraulic circuit, said hydraulic control circuit being a closed loop circuit and said hydraulic fluid-pumping means comprising a reversible variable displacement pump and said hydraulic motor means comprising a reversible fixed displacement motor, said flow-reversing means including a fluid pressure-operated servo cylinder and piston means for reversing said reversible pump and a flow-reversing valve means, said flow-reversing valve means being normally biased to a position providing operation of said hydraulic motor in a desired normal direction of rotation, said reversing valve means being solenoid actuated to a flow-reversing position to direct fluid flow to said servo piston and cylinder means to reverse said pump and thereby reverse the direction of fluid flow through said circuit means to reverse said motor.

3. A drive arrangement according to claim 2 wherein said hydraulic fluid-pumping means includes a fixed displacement servo pump coupled to means for driving said variable displacement pump for supplying fluid to a pilot control subcircuit including said flow-reversing valve means and said servo piston and cylinder means to operate said servo cylinder and piston means.

4. A drive arrangement according to claim 2 including electrically operable time delay means in said electrical control circuit means operable to maintain said flow-reversing means activated and to deactivate said flow-reversing means after a predetermined period of time following actuation thereof.

5. A drive arrangement according to claim 2 wherein said time delay means includes a time delay relay energized by said switch means when said hydraulic pressure reaches said upper limit level, said time delay relay having a relay contact operable when said relay is energized to energize said electrically operable means for actuating said flow-reversing means to reverse flow through said motor means and being operable to deenergize said electrically operable means to deactivate said flow-reversing means and cause the flow in said circuit means to resume said constant direction of flow after the lapse of a predetermined period of time following the energizing of said relay.

6. A drive arrangement for a shredding apparatus in which a pair of parallel spaced-apart driven cutter shafts mount coacting counterrotating disc-type cutter elements, said drive arrangement comprising:

hydraulic fluid-pumping means, reversible hydraulic motor means, hydraulic fluid circuit means containing said hydraulic pumping means and said hydraulic motor means, flow-reversing means for reversing the flow of hydraulic fluid in said hydraulic circuit from said pumping means to said hydraulic motor means, electrically operable means for actuating said flow-reversing means including a fluid pressure-operated electrical switch means in an electrical control circuit sensitive to hydraulic pressure in said hydraulic circuit, said hydraulic fluid circuit means comprising an open loop circuit and said hydraulic fluid-pumping means comprising a fixed displacement pump and said hydraulic motor means comprising a fixed displacement reversible hydraulic motor, said hydraulic fluid circuit means including a hydraulic fluid supply passage means leading from said fixed displacement pump to an inlet side of said fixed displacement motor and a fluid return passage means leading from an outlet side of said fixed displacement motor to a reservoir for said pump, said flow-reversing means comprising a flow-reversing valve for controlling the direction of fluid flow from said fixed displacement pump to said fixed displacement motor through said supply and return passage means, said valve being spring-biased to a position wherein said hydraulic pressure fluid is delivered through said supply passage means to the inlet side of said motor, said valve being solenoid operated to reverse the flow of fluid in said supply and return passage means to reverse the operation of said motor, a time delay means in said electrical control circuit, said pressure-operated electrical switch means being sensitive to fluid pressure in one of said supply and return passage means to actuate said solenoid in response to a predetermined high pressure and simultaneously actuate said time delay means to de-energize said solenoid after a lapse of a predetermined period of time following the energization thereof.

7. A drive arrangement for a shredding apparatus in which a pair of parallel spaced-apart driven cutter shafts mount coacting counterrotating disc-type cutter elements, said drive arrangement comprising:

hydraulic fluid-pumping means, reversible hydraulic motor means, hydraulic fluid circuit means containing said hydraulic pumping means and said hydraulic motor means, flow-reversing means for reversing the flow of hydraulic fluid in said hydraulic circuit from said pumping means to said hydraulic motor means, electrically operable means for actuating said flow-reversing means including a fluid pressure-operated electrical switch means in an electrical control circuit sensitive to hydraulic pressure in said hydraulic circuit, said electrical control circuit including a first subcircuit portion including a time delay relay means, a second subcircuit portion including a normally open time delay relay contact and a solenoid for actuating said flow-reversing means, and a third subcircuit portion including said fluid pressure-operated switch means and said time delay relay means such that pressure actuation of said switch means energizes said time delay relay means to close said time delay relay contact and energize said solenoid to actuate said flow-reversing means, and such that said relay contact reopens to de-energize said solenoid after a lapse of a predetermined period of time following the energizing of said solenoid to deactivate said flow-reversing means.

8. A drive arrangement for a shredding apparatus in which a pair of parallel spaced-apart driven cutter shafts mount coacting counterrotating disc-type cutter elements, said drive arrangement comprising:

hydraulic fluid-pumping means, reversible hydraulic motor means, hydraulic fluid circuit means containing said hydraulic pumping means and said hydraulic motor means, flow-reversing means for reversing the flow of hydraulic fluid in said hydraulic circuit from said pumping means to said hydraulic motor means, electrically operable means for actuating said flow-reversing means including a fluid pressure-operated electrical switch means in an electrical control circuit sensitive to hydraulic pressure in said hydraulic circuit, said hydraulic motor means comprising a radial piston hydraulic motor driving said pair of cutter shafts from a common output shaft through a train of gears arranged to rotate one of said shafts in a direction opposite to the direction of rotation of the opposite said shaft and at a rotational speed greater than that of said opposite shaft.

9. A drive arrangement for a shredding apparatus in which a pair of parallel spaced-apart driven cutter shafts mount coacting counterrotating disc-type cutter elements, said drive arrangement comprising:

hydraulic fluid-pumping means, reversible hydraulic motor means, hydraulic fluid circuit means containing said hydraulic pumping means and said hydraulic motor means, flow-reversing means for reversing the flow of hydraulic fluid in said hydraulic circuit from said pumping means to said hydraulic motor means, electrically operable means for actuating said flow-reversing means including a fluid pressure-operated electrical switch means in an electrical control circuit sensitive to hydraulic pressure in said hydraulic circuit, said hydraulic fluid-pumping means comprising a fixed displacement pump and said hydraulic motor means comprising a fixed displacement reversible hydraulic motor, said flow-reversing means including a flow-reversing valve means for controlling the direction of fluid flow through said hydraulic circuit means to said fixed displacement motor, said valve means normally being positioned at hydraulic circuit pressures below a predetermined maximum pressure to cause fluid flow through said motor in one direction for operating said motor in a normal directional mode for shredding, an electrical solenoid means in said electrical control circuit operable when energized to position said valve means to reverse the direction of fluid flow through said motor to operate said motor in a reverse directional mode to prevent shredding, a time delay means in said electrical control circuit, said pressure-operated electrical switch means being operable to energize said solenoid means and said time delay means at said predetermined maximum fluid pressure to operate said motor in its reverse directional mode, thereby tending to reduce the pressure in said hydraulic circuit means below said maximum pressure, said time delay means being operable to de-energize said solenoid means and return said valve means to its normal operating position to operate said motor in its normal directional mode after a lapse of a predetermined short period of time following the energizing of said time delay means.

10. A drive arrangement according to claim 8 including electrically operable time delay means in said electrical control circuit means operable to maintain said flow-reversing means activated and to deactivate said flow-reversing means after a predetermined period of time following actuation thereof.

11. A drive arrangement according to claim 10 wherein said time delay means includes a time delay relay energized by said switch means when said hydraulic pressure reaches said upper limit level, said time delay relay having a relay contact operable when said relay is energized to energize said electrically operable means for actuating said flow-reversing means to reverse flow through said motor means and being operable to de-energize said electrically operable means to deactivate said flow-reversing means and cause the flow in said circuit means to resume said constant direction of flow after the lapse of a predetermined period of time following the energizing of said relay.

* * * * *

UNITED STATES PATENT OFFICE

CERTIFICATE OF CORRECTION

PATENT NO. : 4,034,918

DATED : July 12, 1977

INVENTOR(S) : MICHAEL CULBERTSON and JAMES E. KELLER

It is certified that error appears in the above-identified patent and that said Letters Patent are hereby corrected as shown below:

Column 4, line 25; "pressure" should be --pressures--;

Column 5, line 42; after "energize" insert --relay--;

Column 5, line 51; "spring-biasing" should be --spring-biased--;

Column 6, line 10; "tis" should be --its--;

Column 8, line 51, claim 5; "claim 2" should be --claim 4--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*